United States Patent [19]

Lujic

[11] 4,319,126

[45] Mar. 9, 1982

[54] TEMPERATURE DEPENDENT ELECTRIC CURRENT-REGULATOR-OR-LIMITING SWITCHING ELEMENT FOR ELECTRICAL APPLIANCES: ESPECIALLY ELECTRICALLY HEATED DEVICES

[75] Inventor: Ante Lujic, Benfeld, France

[73] Assignee: Eaton Corporation, Cleveland, Ohio

[21] Appl. No.: 102,597

[22] Filed: Dec. 12, 1979

[30] Foreign Application Priority Data

Dec. 13, 1978 [DE] Fed. Rep. of Germany ..... 2853776

[51] Int. Cl.[3] ..... H05B 1/02

[52] U.S. Cl. ..... 219/512; 219/494; 219/517; 337/3; 337/96; 337/299; 337/337; 337/362

[58] Field of Search ..... 219/517, 494, 251, 253, 219/512, 511; 337/2, 4, 3, 6, 8, 96, 362, 363, 257, 252, 299, 300, 335–338, 364, 365

[56] References Cited

U.S. PATENT DOCUMENTS

| | | | |
|---|---|---|---|
| 888,381 | 5/1908 | Andrews et al. | 219/517 |
| 2,255,021 | 9/1941 | Dillman | 337/363 |
| 2,366,387 | 1/1945 | Crise | 337/364 |
| 2,707,215 | 4/1955 | Chinn | 337/3 |
| 2,786,171 | 3/1957 | Clark | 337/364 X |
| 3,047,771 | 7/1962 | Clark | 337/364 X |
| 3,611,235 | 10/1971 | Rose | 337/4 |
| 3,733,571 | 5/1973 | Budlane et al. | 337/363 |
| 3,835,294 | 9/1974 | Krohn et al. | 219/517 |
| 3,958,197 | 5/1976 | Gryctko | 337/6 |
| 4,100,397 | 7/1978 | Kunimi | 219/517 |

FOREIGN PATENT DOCUMENTS

| | | | |
|---|---|---|---|
| 147354 | 7/1920 | United Kingdom | 337/96 |

*Primary Examiner*—B. A. Reynolds
*Assistant Examiner*—M. Paschall
*Attorney, Agent, or Firm*—R. J. McCloskey; R. A. Johnston

[57] ABSTRACT

A temperature responsive switching device is provided in which a pair of spaced bimetallic electrical switching arms each are anchored to opposite sides of a mounting block for attachment to the respective power leads of an electrical supply circuit. The free end of the spaced bimetallic arms each contain an electrical contact. A central arm is disposed between the contacts and has a neutral contact mounted thereon such that each of the contacts on the bimetallic arm is biased at room temperature into contact with the central electrical contact. Upon one of the bimetallic arms experiencing a predetermined temperature the circuit is broken by deflection of the bimetallic arm. Upon the switch experiencing a second predetermined but higher temperature, the second bimetallic arm is deflected to open the circuit. In another embodiment, one of the bimetallic arms has the end thereof linked to the central contact by a solder link which upon the switch experiencing the higher predetermined temperature, melts the solder, permitting the arm to open the circuit.

11 Claims, 4 Drawing Figures

TEMPERATURE DEPENDENT ELECTRIC CURRENT-REGULATOR-OR-LIMITING SWITCHING ELEMENT FOR ELECTRICAL APPLIANCES: ESPECIALLY ELECTRICALLY HEATED DEVICES

BACKGROUND OF THE INVENTION

This invention pertains to a temperature dependent electric current regulator or limiting circuit element for electrical appliances, especially electrically heated appliances which employ a thermo-sensitive circuit switch with an automatic switchable contact pair activated by a predetermined given temperature.

Electrically heated appliances such as, for example, heating pads, electric blankets, coffee makers and similar devices are provided with an electric current regulator which cuts off the current of the electric heating resistors when a given rated temperature has been obtained. The heating resistors are then automatically reconnected with the current source when the temperature drops once again to a preset value. The temperature is held within a given tolerance range on a preselected value by means of a two-point control. The current control switching elements also serve in this design as current limiting switching elements. When the current surge is excessive as, for example, when parts of the appliance heating resistors are shorted, an automatic cutoff takes place.

In order to avoid fire hazard safety regulations usually require that when such a current regulator or current limiter switching element (also designated as thermostat) breaks down, that the associated instrument will automatically cut off when a preset limiting temperature has been reached. It is known to connect in series with the current regulator or limiting switching element, a safety thermostat. This thermostat is adjusted to a given limiting temperature. When the limiting temperature is reached, the circuit of the heat resistors is interrupted, if this function has not already been carried out, by the current control or limiting switching element.

The arrangement and use of two separate switching elements is expensive in terms of material and manufacturing cost. Furthermore, in some devices there is insufficient space for accommodating these elements.

SUMMARY OF THE INVENTION

The purpose of this invention is, therefore, to create a temperature dependent current control or limiting switching element that has a compact and simple design and, in addition, one which provides an auxiliary in case the thermosensitive switching device breaks down. The device of the present invention also, allows for relatively inexpensive manufacture as compared to devices employing two separate switching elements.

In order to solve the above-described problem, a temperature dependent current control or limiting switching element has been invented which is characterized by the contact pair, with a temperature sensitive switching device and a thermal trigger, electrically connected in series and combined into a single unit. The device of the present invention is provided with connecting elements for electrical cables and is provided with a mechanical mounting device. The thermal trigger is set for tripping at a limiting temperature which is higher than the rated temperature of the thermo-sensitive switching element.

The thermal trigger is directly combined with the current control or limiting switching device in one mechanical unit thereby forming a unitary instrument. This unit can be shaped in such a way that its volume is only slightly larger than that required for the single current control or limiting switching element.

A preferred design version allows for the thermo-sensitive switching device to be formed by a directly or indirectly heated bimetallic strip while, on the other hand, the thermal trigger is also provided with a directly or indirectly heated bimetallic strip.

At least one of the bimetallic strips can be designed as a snap switch with the other bimetallic strip, for example, the one serving as a thermal trigger, employed to operate with a delay time.

A very simple mechanical arrangement is provided if the bimetallic strip of the thermo-sensitive switching device and that of the thermal trigger are paired with a fixed contact. This contact can be arranged on a tongue that is anchored at one end and which rests between the two bimetallic strips which hold the movable contact.

The current control and limiting switching element with its bimetallic strips tuned to two different switching temperatures, can be used not only as a limit temperature cut-out, but, it can also be used for switching between two temperatures.

In another design version the thermal trigger can be formed by a solder link. In such an arrangement the link is connected immediately next to a holding piece that carries a fixed contact thus minimizing space requirements. The solder link is placed on an electrically conducting bimetallic strip that is anchored on one end. A tongue is held on one end and has a fixed contact on the free end which rests between the bimetallic strip of the switching element that carries the movable contact and the metallic strip.

Preferably, the tongue is anchored in a heat resistant electrically insulated molded piece adapted for mechanical attachment thereto. The bimetallic strip of the thermo-sensitive switching device and the bimetallic strip or the metallic strip of the thermal trigger are mounted on the molded piece in spaced arrangement on opposite sides of the tongue.

DETAILED DESCRIPTION

Figure 1:
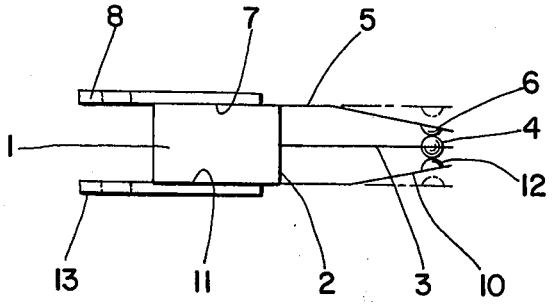
FIG. 1 is a plan view of one form of the invention.
Figure 2:
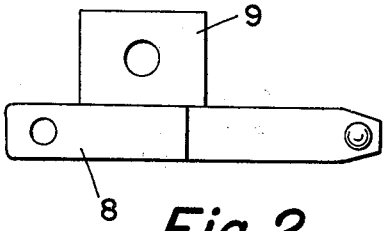
FIG. 2 is a side view of the embodiment of FIG. 1.

Referring now to FIGS. 1 and 2 the contact plate 8 is adapted for attachment to an electric power supply not shown in the figure. The molded piece 1 is provided with a mounting device comprising a mounting lashing 9 which is embedded in the molded piece and protrudes along the side thereof. The mounting lashing 9 can also be formed as one piece with the contact plate 8 if this should be desired for electrical reasons or for reasons of assembly.

Figure 3:
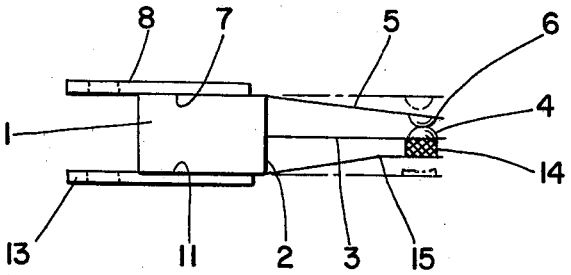
FIG. 3 is a plan view similar to FIG. 1, of an alternate embodiment; and, FIG. 4 is a side view of the embodiment of FIG. 3.

A bimetallic strip 5 is attached to the molded piece 1, along one side thereof and constitutes a thermo-sensitive electrical switching device which functions to separate the contacts 4 and 6 from another when a certain temperature, for which the bimetallic strip 5 has been preset, is reached. The bimetallic strip 5 assumes the dashed-in position as shown in FIGS. 1 and 3 upon experiencing the preset temperature. As soon as the temperature drops below a preset value, the bimetallic strip 5 returns to the configuration shown in solid outline in FIG. 1 and the two contacts 4, 6 will again close.

In series with the contacts 4 and 6 is connected a thermal trigger which construction piece together with in the design variation shown in FIGS. 1 and 2, includes a second bimetallic strip 10, whose one end is connected on the side 11 of the molded piece 1 which is opposite side 7. The second bimetallic strip 10 has on its other end a movable contact 12 which works in consort with the rigid contact 4 from the other side as well as the movable contact 6 to complete a circuit. The bimetallic strip 10 of the thermal trigger is adjusted to a limiting trigger temperature which is higher than the switching temperature of the bimetallic strip 5. Furthermore, strip 10 is electrically connected with an electric attachment terminal 13.

The two bimetallic strips 5, 10 can be arranged in such a manner that they both act, respectively, under a snapping influence. However, the arrangement can also be such that one of the bimetallic strips 5, 10, for example, the bimetallic strip 10 which is paired with the thermal trigger, is provided with a certain time delay response.

The bimetallic strips 5, 10 can be heated directly, so that they respond directly to the heat of the heat resistors of the respective appliance. Alternatively, the bimetallic strips 5, 10 can also be made sensitive to the current. In the latter arrangement, when an excess current is encountered, the heat generated in the bimetallic strips themselves or the heat generated in the auxiliary resistors which are heat interchanged with the bimetallic strips, causes an automatic activation of the switching contacts 6, 4 or 12, 4.

It will be understood that the switching element depicted in FIGS. 1 and 2 can also be used when it is necessary that the switching contacts be triggered at two different temperatures.

Figure 4:
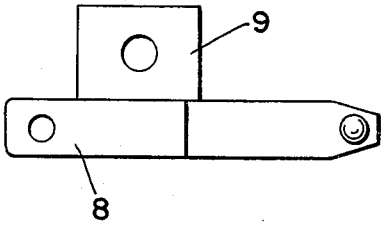

In the design versions shown in FIGS. 3 and 4, the thermal trigger is provided with a solder link 15 which is mounted along the end of a conducting, tongue-like metal strip 15. The metal strip 15 is, similar to the second bimetallic strip 10 in FIGS. 1 and 2, and is attached at one end thereof to the side surface 11 of the molded piece 1 in such a way that the rigid contact 4 on the metal tongue 3 rests between the bimetallic strip 5 and the metallic strip 15. The solder link 14 acts in a manner of a fuse: that is, it is set for a given limiting temperature. When this limiting temperature is reached, the fuse melts causing the electric circuit to be interrupted. As shown in FIG. 3, the solder link 14 is joined with the rigid contact 4.

To ensure an absolutely secure break of the electric circuit when the fuse 14 is melted, the metallic strip 15 is made in the form of a spring and prestressed in the manner shown in FIG. 3 by movement from the dashed line position in FIG. 3 to the solid outline position. When the solder link 14 is melted through, the metal strip 15, responding to a spring effect, is quickly brought into the position indicated by the dashed outline. This causes an immediate break in the electric circuit. In the embodiment of FIG. 3, the metallic tongue 3 and the bimetallic strip 10 as well as the metallic strip 15 are preferably attached on the same side of the molded piece 1. However, other arrangements are possible. The illustrated arrangement, however, assures an especially compact, simple and securely operating design. The tongue 3 can also be made of elastic or spring material so as to assure rapid switching.

I claim:

1. A temperature responsive electrical switching device characterized in that the device has (a) mounting means;

(b) a first and second electrical contact, at least one of which is supported on said mounting means by a temperature responsive member operable to open said contact pair upon experiencing a first predetermined temperature; and, (c) normally conductive trigger means electrically in series with said contact pair and supported by said mounting means, said trigger means including a second temperature responsive member and being operative upon experiencing a second predetermined temperature, to become open-circuit.

2. A temperature responsive electrical switching device comprising:

(a) base means;

(b) first and second normally closed electrical contact means supported on said base, said first contact means being supported by a temperature responsive member operable to cause said first and second contact means to become open circuit upon said temperature responsive means experiencing a first predetermined temperature; and, (c) third electrical contact means electrically in series with said first and second contact means and normally contacting said second contact means, said third contact means being supported on said base and including temperature responsive means operable upon experiencing a second predetermined temperature to cause said second and third contact means to become open circuit, wherein said base means includes means adapted for electrical connection to the supports for said first and third contact means.

3. The device defined in claim 2, wherein said third contact means includes a temperature responsive bimetal member operable to move said third contact away from said second contact means.

4. The device defined in claim 2, wherein said third contact means includes an elastically biased support member and a fusible link joining said third contact means to said second contact means.

5. The device defined in claim 2 wherein said temperature responsive member is operative to provide a snap-action between said first and second contact means.

6. The device defined in claim 2 wherein said support means includes means operative to provide a snap-action between said second and third contact means.

7. The device defined in claim 2, wherein said base means comprises a unitary member.

8. The device defined in claim 2, wherein said base means comprises a unitary member formed of electrical insulating material.

9. A temperature responsive electrical switching device comprising:

(a) a base, (b) a first, second and third electrical contact electrically in series, with said second contact disposed between said first and third contacts and in normally closed arrangement, with each of said contacts being supported by a member extending from said base, wherein one of said first and third contact support members is temperature responsive and operable to cause said one supported contact to become open circuit with said second contact upon said temperature responsive member experiencing a first predetermined temperature; and, (c) means electrically in series with said second and the other of said first and third contacts operable upon experiencing a second predetermined temperature to cause the other of said first and third contacts to become open circuit with said second contact.

10. The device defined in claim 9, wherein said means responsive to said second predetermined temperature comprises a fusible link between said second and third contacts.

11. The device defined in claim 9, wherein said means responsive to said second predetermined temperature comprises a bimetal support arm for said third contact.

* * * * *